US008225457B2

(12) United States Patent
Sanderson et al.

(10) Patent No.: US 8,225,457 B2
(45) Date of Patent: Jul. 24, 2012

(54) HANDLE ASSEMBLY FOR A CLEANING APPLIANCE

(75) Inventors: Alan Glynn Sanderson, Malmesbury (GB); Hadley White, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 652 days.

(21) Appl. No.: 12/376,277

(22) PCT Filed: Jul. 16, 2007

(86) PCT No.: PCT/GB2007/002675

§ 371 (c)(1), (2), (4) Date: Aug. 11, 2009

(87) PCT Pub. No.: WO2008/017803

PCT Pub. Date: Feb. 14, 2008

(65) Prior Publication Data

US 2010/0000044 A1 Jan. 7, 2010

(30) Foreign Application Priority Data

Aug. 8, 2006 (GB) ..... 0615686.3

(51) Int. Cl.
*A47L 5/32* (2006.01)

(52) U.S. Cl. ..... 15/410; 15/334; 15/335

(58) Field of Classification Search ..... 15/331, 15/334, 335, 410; *A47L 5/32*
See application file for complete search history.

(56) References Cited

U.S. PATENT DOCUMENTS 2,660,457 A 11/1953 Mallon
2,867,833 A 1/1959 Duff
4,377,882 A 3/1983 Dyson
4,519,113 A 5/1985 Hipple
4,573,236 A 3/1986 Dyson
4,955,106 A 9/1990 Stein et al.
4,989,295 A 2/1991 Guehne et al.
5,054,157 A 10/1991 Werner et al.
5,331,715 A 7/1994 Johnson et al.
5,358,290 A 10/1994 Fleet et al.

(Continued)

FOREIGN PATENT DOCUMENTS

CA 2 374 892 9/2002

(Continued)

OTHER PUBLICATIONS

Gammack, P. et al., U.S. Office Action mailed Jun. 24, 2010, directed to U.S. Appl. No. 11/632,851; 12 pages.

(Continued)

*Primary Examiner* — David Redding
(74) *Attorney, Agent, or Firm* — Morrison & Foerster LLP

(57) ABSTRACT

A handle assembly for a cleaning appliance includes a handle portion for maneuvering the handle assembly during use, a flexible hose having a first end connectable to a main body of the cleaning appliance and a second end connectable to the handle portion, and a tubular wand. The tubular wand is slidably mounted in the handle portion so as to be moveable between a first position in which the tubular wand extends along the handle portion inside the flexible hose and a second position in which the tubular wand extends beyond the handle portion away from the flexible hose. The handle is releasably attachable to the main body by a catch mechanism arranged so as to release the handle portion from the main body when the tubular wand is moved from the first position to the second position.

16 Claims, 6 Drawing Sheets

U.S. PATENT DOCUMENTS

| | | | |
|---|---|---|---|
| 5,462,311 | A | 10/1995 | Cipolla |
| 5,867,862 | A | 2/1999 | Ahlf et al. |
| 6,032,328 | A | 3/2000 | Harmon et al. |
| 6,108,861 | A | 8/2000 | Vystrcil et al. |
| 6,158,089 | A | 12/2000 | Monahan et al. |
| 7,877,837 | B2 | 2/2011 | Gammack et al. |
| 7,891,050 | B2 | 2/2011 | Liddell |
| 2003/0101535 | A1 | 6/2003 | Gammack et al. |
| 2004/0111828 | A1 | 6/2004 | Evans |
| 2008/0244860 | A1 | 10/2008 | Gammack et al. |
| 2009/0038111 | A1 | 2/2009 | White et al. |
| 2009/0038112 | A1 | 2/2009 | Wood |
| 2009/0158548 | A1 | 6/2009 | Helps et al. |

FOREIGN PATENT DOCUMENTS

| | | |
|---|---|---|
| CN | 1136270 | 11/1996 |
| CN | 2347538 | 11/1999 |
| CN | 1284843 | 2/2001 |
| CN | 2669782 | 1/2005 |
| CN | 101053500 | 10/2007 |
| EP | 0037674 | 10/1981 |
| EP | 0134654 | 3/1985 |
| EP | 0 537 457 | 4/1993 |
| EP | 0 937 435 | 8/1999 |
| EP | 1 265 519 | 12/2002 |
| EP | 1 380 247 | 1/2004 |
| GB | 2 329 944 | 4/1999 |
| GB | 2359735 | 9/2001 |
| GB | 2 392 827 | 3/2004 |
| GB | 2 413 943 | 11/2005 |
| GB | 2416296 | 1/2006 |
| GB | 2 439 915 | 1/2008 |
| GB | 2 440 718 | 2/2008 |
| JP | 45-545 | 1/1970 |
| JP | 56-91558 | 7/1981 |
| JP | 3-261434 | 11/1991 |
| JP | 4-303406 | 10/1992 |
| JP | 2005-143724 | 6/2005 |
| JP | 2007-185222 | 7/2007 |
| WO | WO-01/65989 | 9/2001 |
| WO | WO-03/101273 | 12/2003 |
| WO | WO-2005/079648 | 9/2005 |
| WO | WO-2005/110178 | 11/2005 |
| WO | WO-2006/008443 | 1/2006 |
| WO | WO-2006/008444 | 1/2006 |

OTHER PUBLICATIONS

Gammack, P. et al., U.S. Office Action mailed Dec. 10, 2010, directed to U.S. Appl. No. 11/632,851; 15 pages.

Gammack, P. et al., U.S. Office Action mailed Oct. 14, 2011, directed to U.S. Appl. No. 11/632,851; 14 pages.

White, R., et al., U.S. Office Action mailed Feb. 10, 2011, directed to U.S. Appl. No. 12/184,858; 6 pages.

Helps, D. F. et al., U.S. Office Action mailed May 27, 2011, directed to U.S. Appl. No. 12/338,785; 7 pages.

International Search report and written opinion mailed on Oct. 8, 2007 directed at counterpart international application PCT/GB2007/002675; 11 pages.

GB Search report mailed on Oct. 26, 2006 directed at counterpart application No. GB0615686.3; 1 page.

Wood, R. M., U.S. Office Action mailed Mar. 30, 2011, directed to U.S. Appl. No. 12/185,635; 7 pages.

Helps, D. F., U.S. Office Action mailed Feb. 7, 2012, directed to U.S. Appl. No. 12/338,785; 6 pages.

HANDLE ASSEMBLY FOR A CLEANING APPLIANCE

REFERENCE TO RELATED APPLICATIONS

This application is a national stage application under 35 USC 371 of International Application No. PCT/GB2007/002675, filed Jul. 16, 2007, which claims the priority of United Kingdom Application no. 0615686.3, filed Aug. 8, 2006, the contents of which prior applications are incorporated herein by reference.

FIELD OF THE INVENTION

The invention relates to a handle assembly for a cleaning appliance, particularly but not exclusively to a handle assembly for a vacuum cleaner of the upright type.

BACKGROUND OF THE INVENTION

The general construction and method of operation of upright vacuum cleaners are both well known. Also well known is the capability of upright vacuum cleaners to be converted from a traditional upright cleaning mode (in which the entire vacuum cleaner is maneuvered across a floor surface) into a cylinder mode for "above-the-floor" cleaning. For such purposes, upright cleaners often incorporate an integral hose and wand arrangement which can be brought into operation when required. In some cases, the hose and wand assembly consists of an integral hose which forms part of the airflow path between the cleaner head and the separation apparatus when the machine is used in upright mode, with one end of the hose being releasable from a socket in the main body when above-the-floor cleaning is to be carried out. A separate wand, which is often carried on the main body of the vacuum cleaner, can then be attached to the hose for improving the reach of the hose and wand assembly. A disadvantage of this type of arrangement is that, when the machine is used in upright mode, the incoming air still has to travel through the hose which unnecessarily increases losses.

Another known type of hose and wand assembly is that used on the Dyson range of upright vacuum cleaners, model numbers DC01, DC03, DC04 and DC07. In these vacuum cleaners, the lower end of the hose is fixedly connected to the main body of the respective cleaner but the upper end is slidingly connected to the tubular portion of a wand handle. The wand handle comprises a moulded handle portion with a tubular wand rigidly connected thereto. The handle portion can be attached to the main body of the vacuum cleaner and used in the manner of a handle, in which case the upper end of the hose is slid to the upper end of the wand so that the wand is then stored inside the hose. When above-the-floor cleaning is required, the handle portion is released from the main body, the upper end of the hose is slid to the lower end of the wand and tools can be attached to the handle portion to effect the cleaning required. A valve arrangement automatically selects the point of entry of the dirty air into the vacuum cleaner: in upright mode the point of entry is via the cleaner head and for "above-the-floor" cleaning the point of entry is via the hose and wand. The principle by which this entire arrangement operates is described in EP 0037674B.

A disadvantage of this arrangement is that, because the handle portion is designed to be used as the handle of the machine in the upright mode, the arrangement of the handle is not ideally suited for "above-the-floor" mode. The user tends to grip the lower end of the wand remote from the handle portion when carrying out "above-the-floor" cleaning, at least when cleaning areas at high levels such as cornices and curtain rails. In a refinement of the arrangement, some Dyson vacuum cleaners have incorporated a hose and wand assembly in which the handle portion and wand can be released from the upper end of the hose, turned around and reconnected in the reverse orientation. This arrangement is shown and described in detail in WO 01/65989 and provides better grip for the user and better balance of the handle and wand during use. A disadvantage of this reverse orientation wand arrangement is that the user is required to disassemble and reassemble the hose and wand assembly prior to use for "above-the-floor" cleaning and then, of course, to repeat the disassembly operation before returning to normal upright mode.

In a further refinement of the wand arrangement of WO 01/65989 the tubular wand is slidably mounted in the handle portion so as to be movable between a first position (for the "above-the-floor" cleaning mode) in which the tubular wand extends beyond the handle portion away from the flexible hose and a second position (for normal upright mode) in which the tubular wand extends beyond the handle portion inside the flexible hose. The arrangement is described in detail in WO 06/08444. The wand arrangement of WO 06/08444 represents an improvement over the wand arrangement of WO 01/65989 as the user is not required to remove and reverse the wand when changing between different vacuuming modes. Nevertheless, even the refined arrangement of WO 06/08444 involves a two-part procedure for assembling (and disassembling) the wand and handle unit when changing between "above-the-floor" cleaning and normal upright mode. During one part of the procedure the tubular wand is moved within the handle portion and, separately the handle assembly is removed from the main body of the machine. The user must carry out the two-stage procedure when changing from normal upright cleaning mode to "above-the-floor" cleaning and again when returning the handle assembly to normal upright mode. A disadvantage of the wand arrangement of WO 06/08444 is that the mode change operation can be time consuming for the user. Some users may find that the handle assembly becomes awkward and difficult to manipulate through a two stage procedure. In addition, the two-stage manual operation can result in incorrect assembly. An incorrect assembly could lead to a reduction in performance due to air being bled into the assembly through inefficient seals.

SUMMARY OF THE INVENTION

The present invention seeks to provide an improved handle assembly for a vacuum cleaner which obviates disadvantages of the prior art.

The invention provides a handle assembly for a cleaning appliance comprising a handle portion for maneuvering the handle assembly during use, a flexible hose having a first end connectable to a main body of the cleaning appliance and a second end connectable to the handle portion, and a tubular wand slideably mounted in the handle portion so as to be moveable between a first position in which the tubular wand extends along the handle portion inside the flexible hose and a second position in which the tubular wand extends beyond the handle portion away from the flexible hose, characterised in that the handle portion is arranged to release the handle portion when the tubular wand is moved from the first position to the second position.

The handle assembly according to the invention has the advantages of the prior art in that it is integral with the vacuum cleaner and does not require separately stored parts to be assembled together before use, and in that the handle portion can be easily gripped and maneuvered during above floor cleaning. In addition, because the handle assembly is released from the main body of the vacuum cleaner by the movement of the tubular wand with respect to the handle portion, the task of releasing the wand and wand handle ready for "above-the-floor" cleaning, is an easy, simple single-step operation for the user. As the handle portion is released when the tubular wand is in the "above-the-floor" mode and wand position, the wand is "ready to go" in one movement. The sometimes awkward, two-stage procedure, is reduced to a single action and can in fact be performed using only one hand. The handle assembly according to the invention is thus easier to operate and more reliable than the known assemblies.

In a preferred embodiment, part of the releasable catch mechanism is located in the handle portion. Preferably part of the releasable catch mechanism is located in the main body. More preferably the release catch mechanism comprises a catch on the main body which interengages with a lip on the handle portion, and facing surfaces located on the catch and the handle portion, the arrangement being such that an axial force applied to the handle assembly will urge the catch into the engagement with the lip. This mechanism ensures that, when the handle is being used for upright mode cleaning, any forces applied to the handle assembly which would encourage the lip and catch to move out of engagement in fact urge the catch further into engagement with the lip. This mechanism will reduce the risk of the handle portion becoming inadvertently released from the main body.

Preferably the catch further comprises a depending portion on the side thereof facing the tubular wand, the depending portion having a contact surface which, in use, is contacted by a catch actuator when the tubular wand is moved from the first position to the second position, and facing surfaces located on the catch and the handle portion, the arrangement being such that an axial force applied to the handle assembly will urge the catch into the engagement with the lip. Preferably the actuator comprises a part having a contact surface which, in use, is contacted by the tubular wand so as to bias the part away from the wand and towards the catch when the tubular wand is moved from the first position to the second position. By this mechanism the catch is urged out of engagement with the handle portion by the actuator when the tubular wand is moved from the first position to the second position. The arrangement ensures that the handle assembly is automatically released form the main body of the vacuum cleaner by the movement of the tubular wand with respect to the handle portion.

In a further preferred embodiment, the tubular wand is held in the second position by a releasable catch mechanism located in the handle portion. Preferably, the releasable wand catch mechanism comprises a catch which interengages with a detent in the tubular wand, and inclined facing surfaces located on the handle portion and the catch, the arrangement being such that an axial force applied to the tubular wand will urge the catch into the detent. This mechanism ensures that, when the handle assembly is being used for "above-the-floor" cleaning, any forces applied to the tubular wand which would encourage it to move from the first position to the second position in fact urge the catch further into engagement with the detent. This is essentially, therefore, a self-locking mechanism and will reduce the risk of the tubular wand becoming inadvertently released from the first position.

Other preferable and advantageous features of the invention are set out in the detailed description.

BRIEF DESCRIPTION OF THE DRAWINGS

An embodiment of the invention will now be described with reference to the accompanying drawings in which.

DETAILED DESCRIPTION OF THE INVENTION

Figure 1:
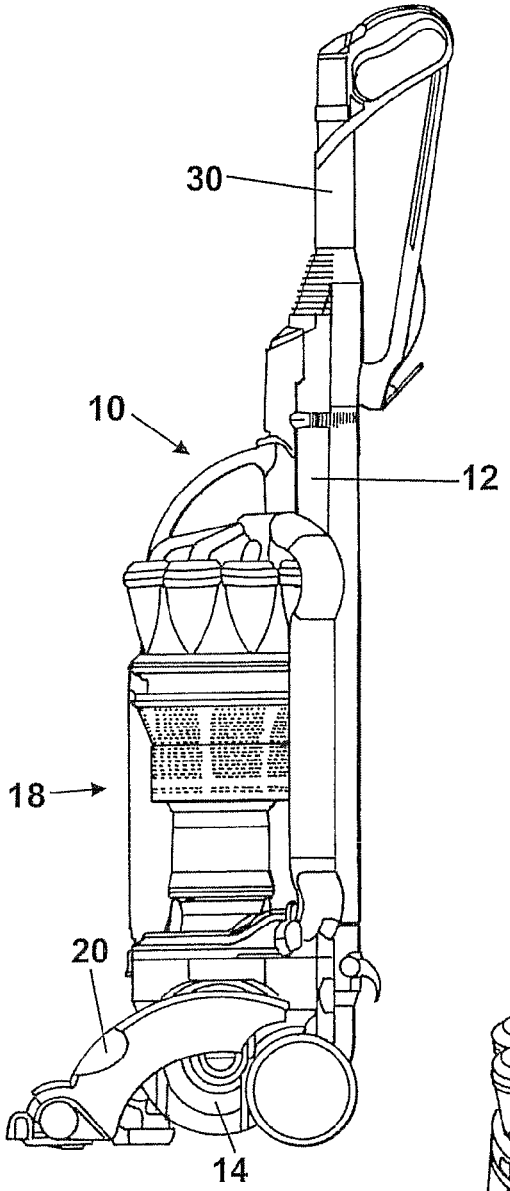
FIG. 1 is a side view of a vacuum cleaner incorporating a handle assembly according to the invention.

A vacuum cleaner incorporating a handle assembly according to the invention is shown in FIG. 1. The upright vacuum cleaner 10 shown in FIG. 1 has a main body 12 which includes a motor casing 14, supporting wheels 16 and dirt- and dust-separating apparatus 18. The vacuum cleaner 10 also has a cleaner head 20 and a handle assembly 30. In the embodiment shown, the dirt- and dust-separating apparatus 18 comprises a cyclonic arrangement but this could readily be replaced by a filter, a bag or a combination of different known separation devices. The nature of the dirt- and dust-separating apparatus 18 is not material to the present invention.

It will be understood that, in normal upright use, the vacuum cleaner 10 is maneuvered over a surface to be cleaned (a floor surface) whilst the motor causes dirty air to be sucked into the cleaner 10 via the cleaner head 20. The dirty air is passed to the dirt- and dust-separating apparatus 18 where the dirt and dust is extracted and clean air is expelled to the atmosphere.

Figure 2:
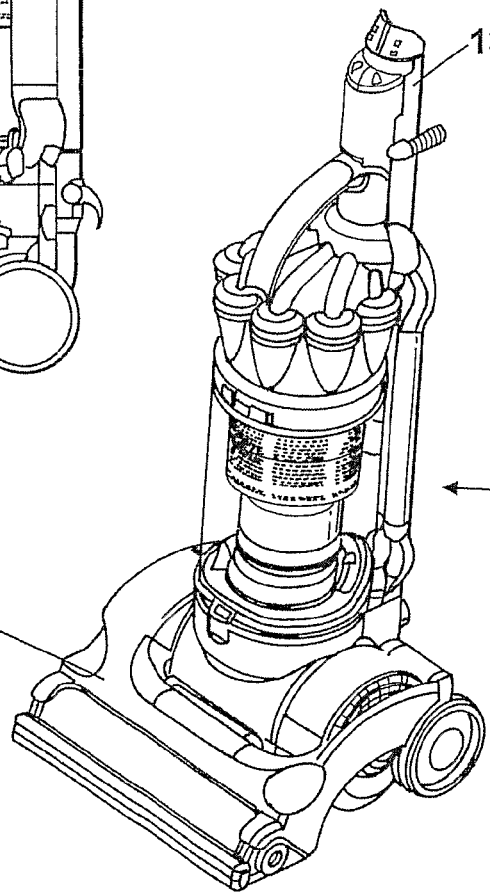
FIG. 2 is a perspective view of the vacuum cleaner of FIG. 1 showing the hose and the wand handle removed from the main body.
Figure 2:
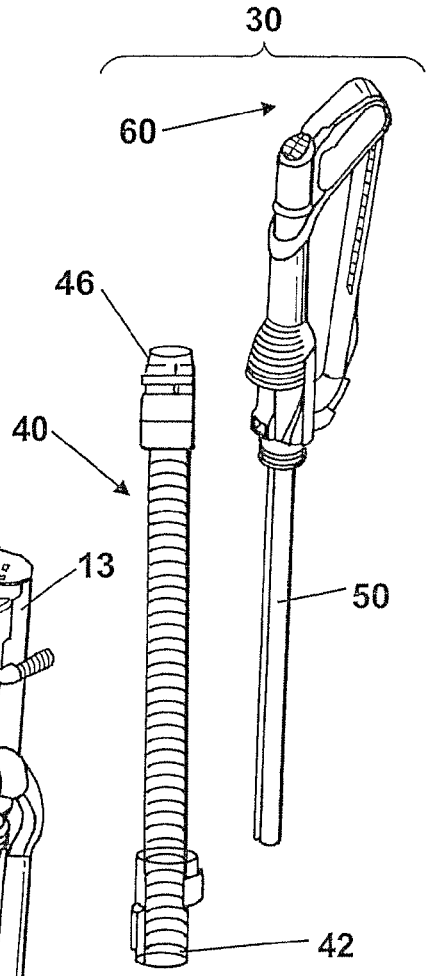

FIG. 2 shows the vacuum cleaner 10 with the handle assembly 30 separated from the main body 12. The handle assembly 30 comprises a hose 40 having a first end 42 and a second end 46, a tubular wand 50 and a handle portion 60. The first end 42 of the hose 40 is normally connected to the main body 12 behind the motor casing 14. The upper end 46 of the hose 40 is connected to the handle portion 60. Both of these connections are preferably releasable connections to facilitate maintenance and repair. The tubular wand 50 is slidably mounted in the handle portion 60 as will be described in more detail below.

Figure 3:
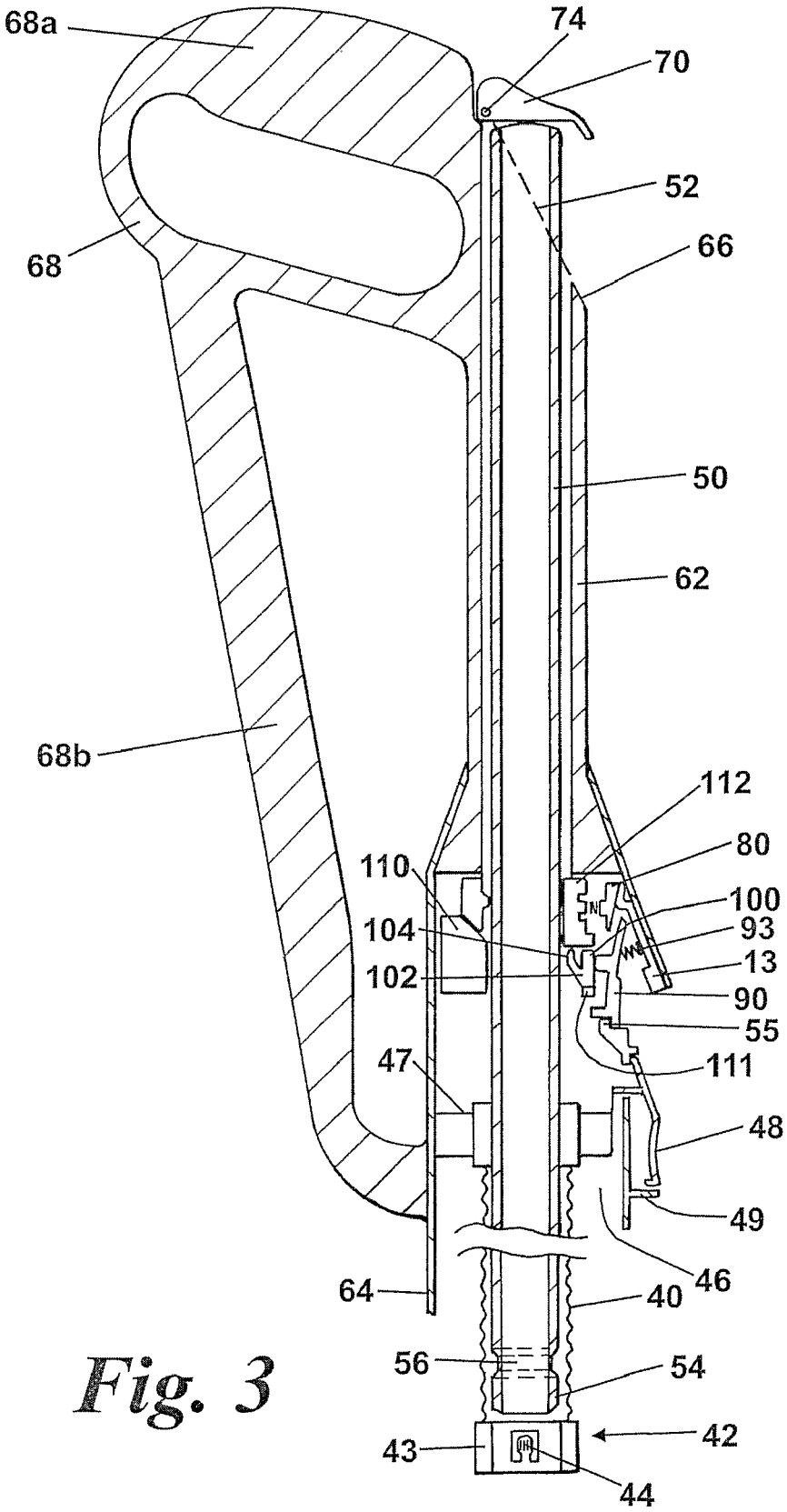
FIG. 3 is a schematic sectional view through the handle assembly forming part of the vacuum cleaner shown in FIGS. 1 and 2 and showing the handle assembly in the first position.
Figure 4:
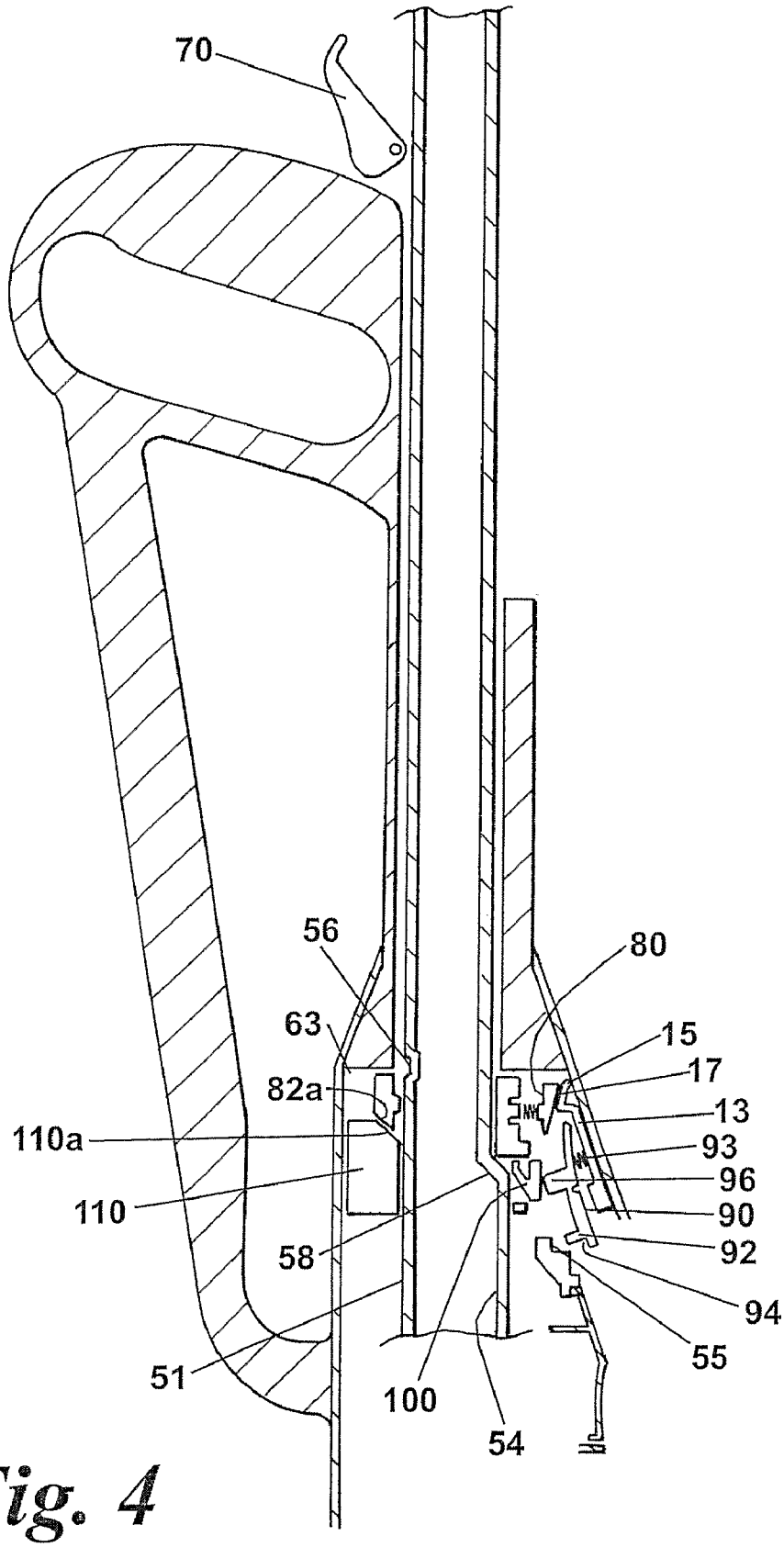
FIG. 4 is a schematic sectional view through a part of the catch mechanism and wand handle of FIG. 3 but showing the handle assembly in between the first and second position at a first stage of removal and showing the catch mechanism in detail.

FIG. 3 shows the handle assembly 30 in detail, although not to scale. FIG. 4 shows details of the handle assembly with tubular wand 50 in a different position to that shown in FIG. 3. The hose 40 is a sprung hose and is ideally (but not essentially) of sufficient length to enable a full flight of stairs to be cleaned with the vacuum cleaner main body 12 remaining at the foot of the stairs. The first end 42 of the hose 40 has a collar 43 overmoulded or otherwise securely fixed thereto with at least one resilient catch 44 incorporated therein. The resilient catch 44 co-operates with a recess (not shown) in a socket on the main body 12 in which the first end 42 of the hose 40 is received. The catch 44 and recess together form a releasable connection between the first end 42 of the hose 40 and the main body 12. This type of connection is well known and similar types of releasable connection would be equally suitable for use in this application.

The second end 46 of the hose 40 has a similar releasable connection formed by a resilient catch 48 moulded into a collar 47 which is overmoulded or otherwise securely fastened to the second end 46 of the hose 40. However, in the case of the second end 46 of the hose 40, the resilient catch 48 is arranged to be received in a recess or aperture 49 moulded into the lower end of the handle portion 60. Again, the type of connection formed by the catch 48 and the recess 49 is well known and could be replaced by another type of connector having similar functionality.

The handle portion 60 will now be described in detail. The handle portion 60 essentially comprises a tubular part 62 having open ends 64, 66. The lower end 64 of the tubular part 62 includes the recess or recesses 49 which receive the resilient catch or catches 48 at the second end 46 of the hose 40. The internal diameter of the tubular part 62 is dimensioned so that the tubular wand 50 is able to slide within the tubular part 62. A gripping handle 68 is integrally moulded or is otherwise fixedly attached to a side wall of the tubular part 62 and extends laterally therefrom. Ideally, the gripping handle 68 has a first gripping area 68*a* which is designed for use when the vacuum cleaner 10 is being used for upright cleaning and a second gripping area 68*b* which is designed for use when the vacuum cleaner 10 is being used for "above-the-floor" cleaning.

A cap 70 is pivotably mounted on the tubular part 62 at the upper end 66 thereof. The cap 70 is moveable between a generally horizontal closed position and a generally vertical open position. The cap 70 has a generally circular shape when viewed from above and has a number of bleed holes through which air is able to pass if required. In the position shown in FIG. 3, the cap 70 covers the upper end of the tubular wand 50, although the bleed holes (not shown) allow air to be drawn into the tubular wand 50 whilst simultaneously preventing large objects from being drawn into the vacuum cleaner 10.

In the embodiment shown the cap 70 is mounted on the upper end of the tubular part 62 by the engagement of two opposed pivot pins 74 (formed on the upper end 66 of the tubular part 62) in corresponding recesses formed in the cap 70. The pivot pins 74 allow the cap 70 to be urged into one of two positions: either the cap 70 is urged into the horizontal position shown in FIG. 3 or it is urged into the substantially vertical position shown in FIG. 4. Other engaging means or shaped fixings for mounting the cap 70 on the tubular part 62 are known and would be equally suitable for use in this application.

The tubular wand 50 is arranged inside the tubular part 62 of the handle portion 60. The tubular wand 50 has upper and lower ends 52, 54. The diameter of the tubular wand 50 is such that it will fit with clearance inside the interior of the tubular part 62 and also inside the hose 40. The tubular wand 50 has a portion 51 of increased diameter near the lower end 54 of the wand. As shown in FIG. 4, the increased diameter portion 51 creates a shoulder 58 on the wand at the point of change of tube diameter. Further, the tubular wand 50 has a groove 56 formed in its outer surface near the lower end 54 thereof. In the embodiment shown in FIG. 4 the location of the groove 56 is further from the lower end 54 of the tubular wand 50 than the shoulder 58. The groove 56 and shoulder 58 co-operate with a catch mechanism forming part of the handle portion 60 as will be described in more detail below. The upper end 52 of the tubular wand 50 is dimensioned so that it is able to receive floor tools and accessory tools (not shown) which are intended to be used with the vacuum cleaner 10 during "above-the-floor" cleaning. The length of the tubular wand 50 is such that, when the cap 70 is in its horizontal position and the hose is in its relaxed (shortest) state, the tubular wand 50 extends between the cap 70 and collar 43 at the first end of the hose 40.

A groove (not shown) extends longitudinally along the entire length of the tubular wand 50 on the side thereof opposite the gripping handle 68. A small protrusion (also not shown) located on the interior of the tubular part 62 projects into the groove to prevent the tubular wand 50 from rotating about its longitudinal axis with respect to the handle portion 60.

The releasable catch mechanism for the handle assembly 30 will now be described in detail. A handle release catch 90 is pivotably mounted on an upper tubular duct 13 of the main body 12 of the vacuum cleaner, as illustrated in FIGS. 3 and 4. The uppermost portion of duct 13 carries a projection 15 with an inclined face 17 on the side thereof facing the direction of the tubular wand 50. The lower end of the handle release catch 90 carries an arm 92 and an elbow 94. In addition, the catch 90 carries a lug 96 on the side thereof facing the direction of the tubular wand 50. Arm 92 and elbow 94 co-operate with a lip 55 on the tubular part 62 of the handle portion 60 of the vacuum cleaner 10 so as to secure the handle assembly 60 onto the main body 12 for storage and for upright cleaning. A spring 93 urges the handle release catch 90 away from the duct 13 and the lip 55 acts as stop means to limit the movement of the handle release catch 90 in that direction.

An actuator 100 is located in a cavity of the tubular part 62 of the handle portion 60. The cavity is created between lower 111, and upper 112, sections of a lock and wand housing 110. The actuator 100 carries a depending portion 102 with an inclined face 104 on the side thereof facing the direction of the tubular wand 50. In the preferred embodiment illustrated in FIGS. 3 and 4 the actuator takes the form of a part arranged to slide from one side of the cavity to the other. The housing and cavity arrangement provide guide means for the actuator 100 to move (and slide) horizontally in response to pressure from a part of the tubular wand 50. The handle release catch 90 is biased towards the tubular wand 50 and the actuator 100 by the action of the spring 93. The housing and cavity arrangement also allow the actuator 100 to come into contact with, and engage with, the handle release catch 90.

Figure 5:
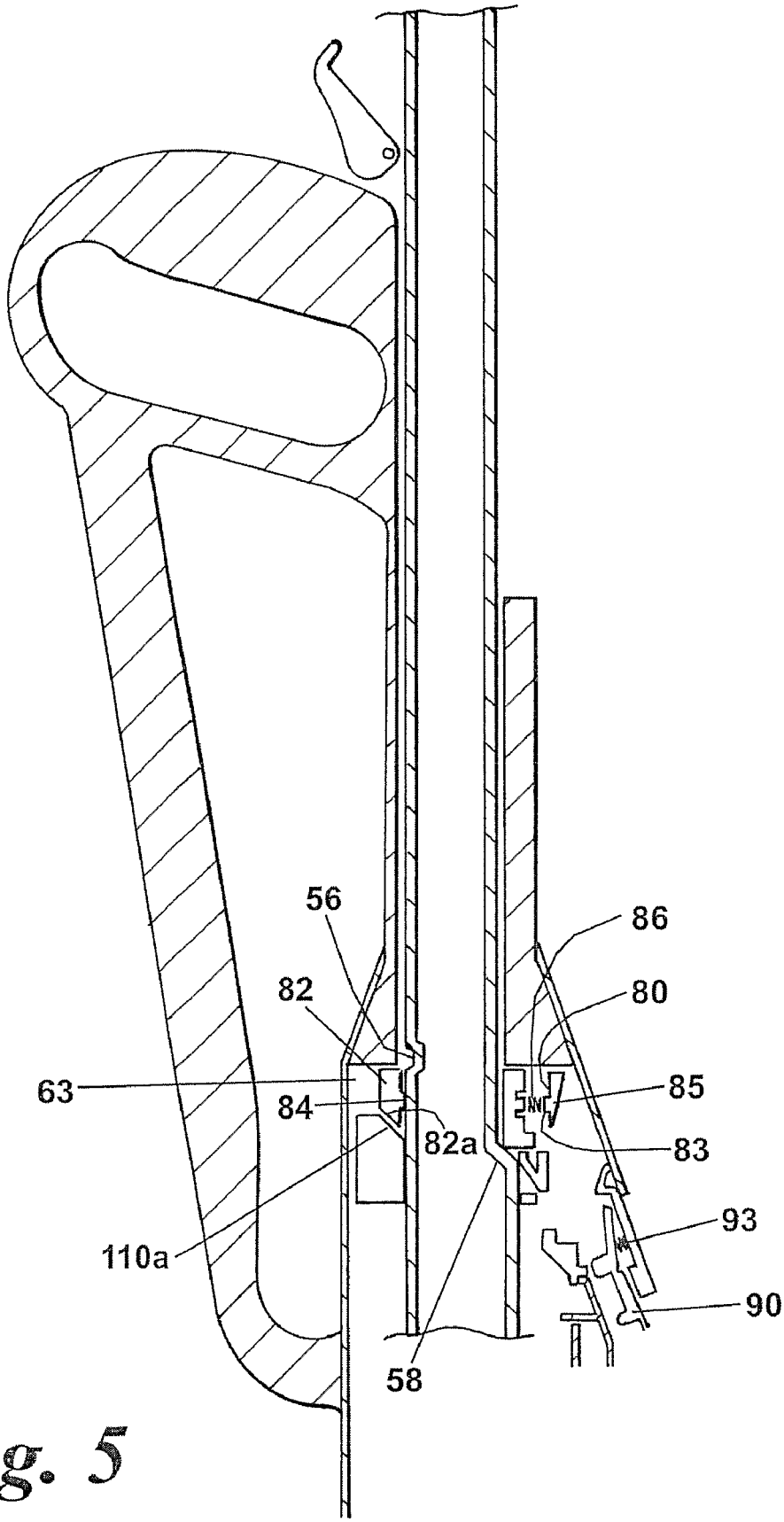
FIG. 5 is a view similar to FIG. 3 but showing the handle assembly in between the first and second position at a further stage of removal.
Figure 6:
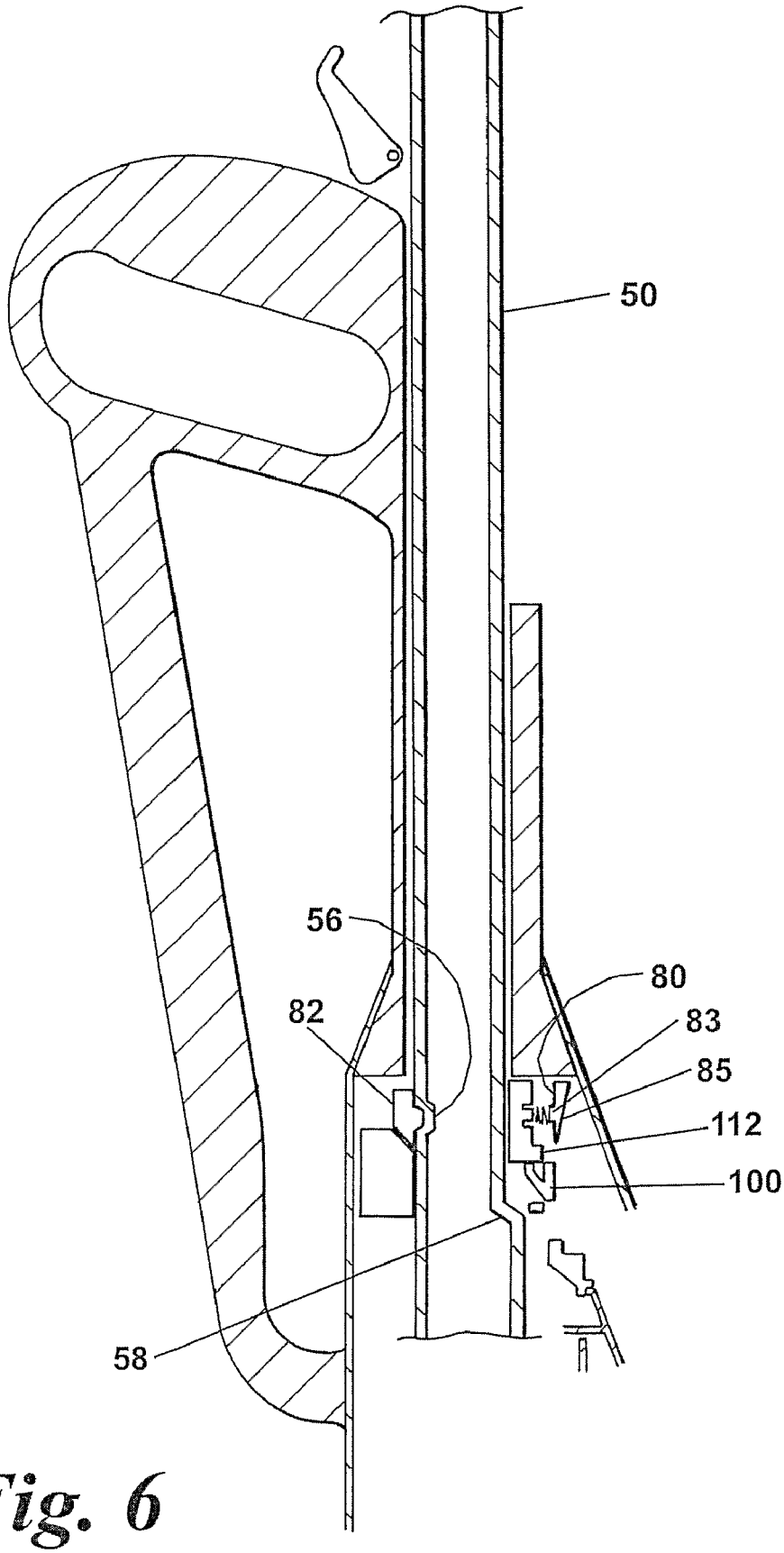
FIG. 6 is a view similar to FIG. 3 but with the handle assembly shown in the second position.

A catch mechanism located in the handle portion 60 and suitable for holding the tubular wand in the second position is shown more clearly in FIGS. 4, 5 and 6. Mounted in an annular recess 63 inside the tubular part 62 is an eccentric ring 80 which surrounds the tubular wand 50. The ring 80 has an enlarged shape part 82 and a tapered shape part 85. The enlarged shape part 82 carries an inwardly extending projection 84 facing towards the tubular wand 50 and an inclined face on the surface thereof facing away from the tubular wand. The projection 84 is dimensioned so as to engage with the groove 56 formed in the tubular wand 50 when the projection 84 and the groove 56 are in alignment. The tapered part 85 carries an inwardly extending projection 83 on the surface thereof facing towards the tubular wand 50 and the tapered part 85 has an inclined face on the surface thereof facing away from the tubular wand. The projection 83 is dimensioned to accommodate a first end of a spring 86. The opposite, second end of the spring 86 is accommodated on a tab or hook formed the upper lock and wand housing 112. The spring 86 urges the ring 80 to the right as shown in FIG. 6 so that, when the projection 84 and the groove 56 are aligned, the projection 84 is moved into the groove 56.

It is to be noted that the shape of the enlarged shaped part 82, the recess 63 and the lock and wand housing 110, are such that the catch mechanism is self-locking. To that end, the lock and wand housing 110 has an inclined wall 110*a* adjacent the enlarged shaped part 82. The enlarged shaped part 82 has a corresponding inclined wall 82*a* facing the wall 110*a* of the lock and wand housing 110. The result is that, when the projection 84 is engaged in the groove 56, any axial forces applied to the tubular wand 50 (resulting in a small amount of relative movement between the tubular part 62 and the eccentric ring 80) will force the projection 84 further into the groove 56. This reduces the risk of the projection 84 slipping out of the groove 56 and causing a sudden and unexpected collapse of the tubular wand 50 into the handle assembly 30.

It will be appreciated that the catch mechanism and ring 80 holding the tubular wand in the second position, as described in the embodiment above, is a mechanism additional to the handle release catch 90. It will further be appreciated that the catch mechanism holding the wand in the second position is operated by the same user action of movement of the tubular wand 50 with respect to the handle portion 60, as that required to operate the handle release catch 90 and thus release the handle assembly 30 from the main body 12 of the vacuum cleaner 10.

In the wand arrangement and catch embodiment shown in FIG. 4 the location of the groove 56 is further from the lower end 54 of the tubular wand 50 than the shoulder 58. This preferred placement of the shoulder 58 and groove 56 ensures that any release of the handle assembly 30 by the handle release catch 90, occurs before the catch mechanism and ring 80 lock and hold the tubular wand in the second position. The arrangement also ensures that on returning the handle assembly 30 to the main body, engagement of the handle release catch 90 and securing of the handle assembly to the main body 12 occurs before the tubular wand 50 is released from the second position and moves down within the tubular part 62.

FIG. 3 illustrates the relative positions of all of the components of the handle assembly 30 when the handle assembly 30 is stored on the main body 12 of the vacuum cleaner 10 or is being used for upright cleaning. The collar 43 is connected to the socket (not shown) on the main body 12. The handle release catch 90 on the upper tubular duct 13 of the main body 12 is engaged with the lip 55 on the handle portion 60 to secure the handle assembly 30 on the main body 12. In this position, the tubular wand 50 is in its first position extending away from the handle portion 60 inside the hose 40. The hose 40 is in its relaxed state and so is as short as possible in this configuration. The lower end 54 of the tubular wand 50 reaches substantially to the first end 42 of the hose 40. The tubular wand 50 is prevented from sliding out of the hose 40 by the fact that the collar 43 has an internal diameter which is slightly smaller than the outer diameter of the tubular wand 50.

The upper end 52 of the tubular wand 50 extends through the tubular part 62 of the handle portion 60 as far as the upper end 66. The cap 70 is in its horizontal position as shown so that the otherwise open upper end 52 of the tubular wand 50 is covered to prevent debris being sucked into the tubular wand 50.

The handle portion 60 is prevented from detaching from the main body 12 by the locking action of the catch arm 92 with the lip 55 on the handle portion 60. The tapered part 85 of eccentric ring 80 is pressed into contact with the main body duct 13, carrying the handle release catch 90. The tapered part of ring 80 is caused to move away from the main duct 13 (towards the left in FIG. 3) within the annular recess 63 by the axial force exerted on tapered part 85 by the inclined face 17 and projection 15 of the duct 13. The force exerted on tapered part 85 means that spring 86, located between the tapered part 85 and the upper lock and wand housing 112 is under compression. Thus the catch mechanism and ring 80 for holding the tubular wand in the second position are urged away from, and out of engagement with, the tubular wand 50.

FIG. 4 illustrates a configuration of the handle assembly 30 at a first stage of removal from the main body 12. In this position, the tubular wand 50 has been slidingly moved upwards relative to the handle portion 60 until the shoulder 58 of the tubular wand becomes aligned with actuator 100. The actuator 100 is moved, or slid, horizontally (to the right in FIG. 4) within the cavity of the lock and wand housing 110 by the action of the shoulder 58 impinging on face 104 of the depending portion 102 of the actuator 100. As stated above, the unimpeded position of the catch 90 is that is pressed away from the handle assembly and towards the main body duct 13 against the action of the spring 93. The movement of the actuator 100 and, in particular, the action of the slider or actuator 100 on lug 96 causes catch 90 to be pressed away from the lip 55 on the handle portion 60 and thus the handle portion 60 is released from the main body.

FIG. 5 illustrates a configuration of the handle assembly 30 at a second stage of removal from the main body 12 and duct 13. In this position the handle assembly 30 has been moved upwards away from main body 12. The tubular wand 50 is prevented from sliding out of the handle assembly 30 by the fact that the lock housing 110 has an internal diameter which is smaller than the outer diameter of the shoulder 58 and enlarged diameter portion 51 of the tubular wand 50.

In the position shown in FIG. 5 the main body duct 13 and the projection 15 are moved away from ring 80 and out of engagement with the tapered part 85. Thus in this position the tapered part 85 is no longer constrained against projection 15 and is free to move, under action of compressed spring 86, away from tubular wand 50 and towards handle duct 62.

FIG. 6 illustrates wand assembly 30 in a configuration fully released from the main body 12. In this position, the tubular wand 50 has been slidingly moved upwards relative to the handle portion 60 until the shoulder 51 has impinged on upper lock housing 112 and then moved downwards relative to the handle portion 60 until the groove 56 becomes aligned with ring 80. The ring 80 is pressed into the groove 56 under the action of the spring 86 between ring 80 and upper lock and wand housing 112. The action of the ring 80 and spring 86 lock the tubular wand 50 relative to the handle portion 60.

Because the lower end 54 of the tubular wand 50 is now located within the handle portion 60, and separate from the main body 12, the hose 40 is free to flex and move in order to facilitate above-floor cleaning.

As the tubular wand 50 is moved from the position shown in FIG. 3 to the position shown in FIG. 4, the cap 70 is pivoted from the generally horizontal position shown in FIG. 3 to the generally vertical position shown in FIG. 4. The pivot pin arrangement described above causes the cap 70 to be held in the generally vertical position whilst the tubular wand 50 remains in its second position.

By the action of the user moving the tubular wand 50 from the position shown in FIG. 3 to the position shown in FIG. 5, the handle assembly is automatically released from the main body 12 of the vacuum cleaner 10. This is achieved simply by the movement of the tubular wand 50 with respect to the handle portion 60. By the same action the tubular wand 50 is locked relative to the handle portion 60.

In this configuration, the handle assembly 30 is highly suitable for above-the-floor cleaning. Furthermore, the self-locking characteristics of the catch mechanism mean that a reasonable amount of force can be applied to the wand 50 without the catch mechanism failing and causing the wand 50 and handle assembly 30 to collapse. In this configuration, it is expected (but not dictated) that the user will grip the handle assembly 30 using the second gripping area 68*b* rather than using the first gripping area 68*a*.

When it is desired to return the handle assembly 30 to the first configuration, the user is able simply to return the handle assembly to the main body 12 and the catch mechanisms are released in a reverse order to the wand and handle assembly removal process.

By fitting the handle portion 60 over the main body duct 13, the projection 15 and the inclined face 17 of the duct are brought into contact with tapered part 85 of ring 80. Firstly, the catch mechanism holding the tubular wand 50 in the second position is released by the action of the projection 84 moving away from the tubular wand 50 and out of engagement with groove 56, against the biasing action of spring 86. Projection 84 is released from the groove 56 under the action of inclined face 17 and projection 15 pressing against the tapered part 85 of the ring 80. The tubular wand 50 is thus able to slide within the handle portion 60 back towards the first position, shown in FIG. 3. The hose 40 is again stored around the tubular wand 50 and the handle assembly 30 is returned to the main body 12 of the vacuum cleaner 10. The handle assembly 30 is reattached to the main body 12 when the actuator 100 is released by the return action. In particular, when the tubular wand 50 is moved within the handle portion 60 such that the shoulder 58 no longer presses against depending portion 102. Thus the actuator 100 is caused to slide horizontally towards the tubular wand by the return action of the handle catch mechanism 90 and lug 96 on the actuator 100 under the spring force of spring 93 between the duct 13 and the catch 90. The handle portion 60 is reattached and locked to the main body by lip 55 engaging with arm 92 of catch mechanism 90. Finally, the cap 70 is pressed into its generally horizontally position by the user.

In the preferred embodiment described here the configuration and inner parts of the handle assembly are dimensioned so that the handle assembly 30 is fixed to the main body duct 13 by the release catch 90 before the tubular wand 50 is released from the catch mechanism holding the tubular wand 50 in the second position.

Figure 7C:
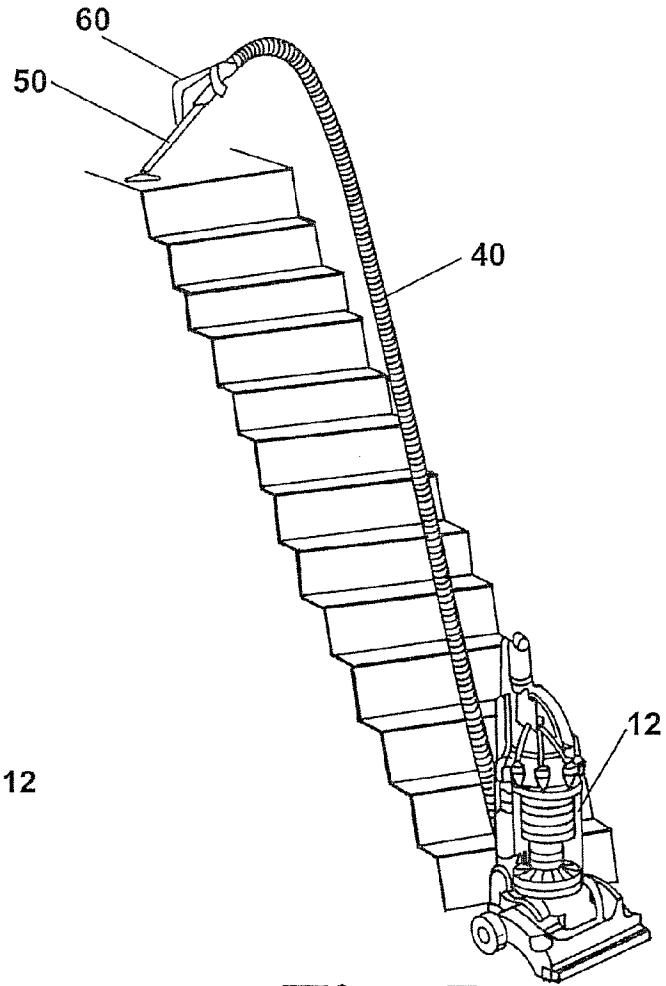
FIGS. 7(*a*), 7(*b*) and 7(*c*) are sequential views of the vacuum cleaner of FIG. 1 illustrating the use of the handle assembly according to the invention.
Figure 7B:
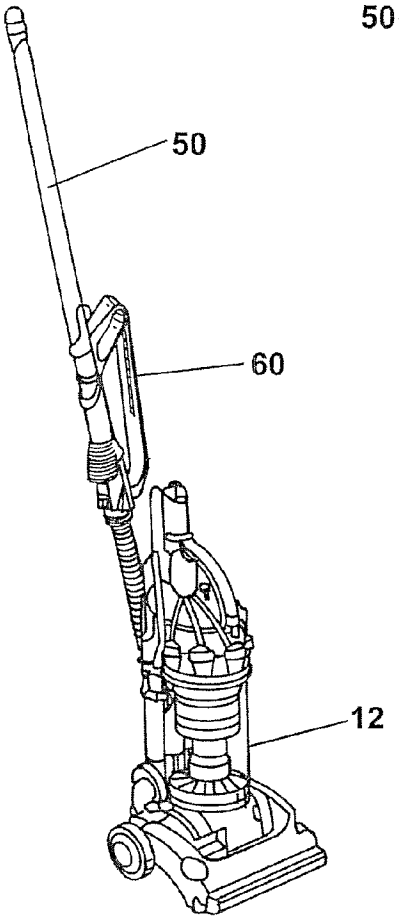
Figure 7A:
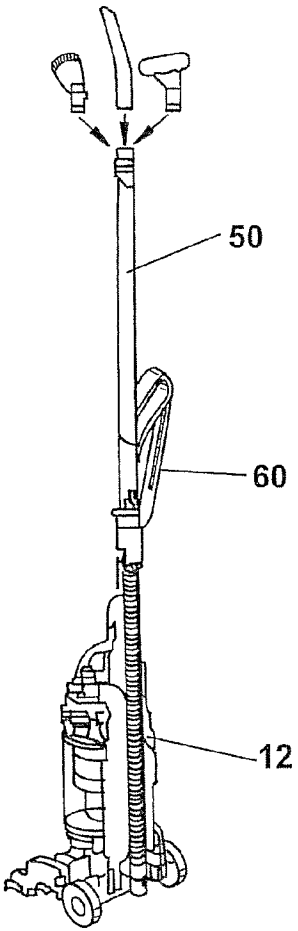

FIGS. 7(*a*), 7(*b*) and 7(*c*) illustrate the intended steps to be taken when converting the vacuum cleaner 10 from upright cleaning to above-the-floor cleaning. First, as shown in FIG. 7(*a*), the tubular wand 70 is extended upwardly with the handle assembly 30 otherwise still attached to the main body 12. Tools may be attached to the upper end of the tubular wand 50. The tubular wand 70 is further extended upwardly to cause the operation of the handle release catch 90 so as to release the handle portion 60 from the main body 12 and the hose 40 is then extended to reach up a flight of stairs or for other above-the-floor cleaning. To re-attach the handle assembly 30, the steps are simply reversed.

It will be appreciated that the invention is not intended to be limited to the specific details of the embodiment described. Different arrangements and modifications will be apparent to a skilled reader. For example, the configuration of the gripping areas could be very different in design, as could the catches and the cap. The shape and orientation of the handle portion and handle assembly on the main body could be different. The catch for releasing the handle assembly from the main body may be integral with the catch mechanism holding the tubular wand in the second position. A possible modification of the handle assembly would be to provide a plastic moulded end portion on the upper end of the tubular wand. Such an end portion would facilitate the attachment of tools and accessories to the wand and would allow the dimensions of the upper end of the wand to be varied without altering the construction of the main part of the tubular wand. A convenient way of attaching such an end portion to the tubular wand is by way of a plastic circlip seated in a groove moulded into the end portion and having projections extending radially inwards to engage with apertures or detents formed in the aluminium wand. Providing an end portion on the upper end of the tubular wand has an added advantage in that, provided that the end portion is larger than the internal diameter of the tubular part of the handle portion, the end portion will act as a stop which prevents the upper end of the tubular wand from becoming inaccessible by sliding to a position inside the handle portion or the hose.

The invention claimed is:

1. A handle assembly for a cleaning appliance comprising a handle portion configured for maneuvering the handle assembly during use, a flexible hose having a first end connectable to a main body of the cleaning appliance and a second end connectable to the handle portion, and a tubular wand slideably mounted in the handle portion so as to be moveable between a first position in which the tubular wand extends along the handle portion inside the flexible hose and a second position in which the tubular wand extends beyond the handle portion away from the flexible hose, wherein the handle portion is releasably attachable to the main body by a releasable catch configured so as to release the handle portion when the tubular wand is moved from the first position to the second position.

2. A handle assembly as claimed in claim 1, wherein part of the releasable catch is located in the handle portion.

3. A handle assembly as claimed in claim 1 or 2, wherein part of the releasable catch is located in the main body.

4. A handle assembly as claimed in claim 1 or 2, wherein the releaseable catch comprises a catch on the main body which interengages with a lip on the handle portion, and facing surfaces located on the catch and the handle portion, the arrangement being such that an axial force applied to the handle assembly will urge the catch into the engagement with the lip.

5. A handle mechanism as claimed in claim 4, wherein the catch further comprises a depending portion on the side thereof facing the tubular wand, the depending portion having a contact surface which, in use, is contacted by a catch actuator when the tubular wand is moved from the first position to the second position, the catch being configured such that an axial force applied to the depending portion of the catch by the actuator will urge the catch out of engagement with the handle portion.

6. A handle mechanism as claimed in claim 5, wherein the actuator comprises a part having a contact surface which, in use, is contacted by the tubular wand so as to bias the part away from the wand and towards the catch when the tubular wand is moved from the first position to the second position.

7. A handle assembly as claimed in claim 1 or 2, wherein the tubular wand is held in the second position by a releasable catch mechanism located in the handle portion.

8. A handle mechanism as claimed in claim 7, wherein the releasable catch mechanism located in the handle portion comprises a catch which interengages with a detent in the tubular wand, and inclined facing surfaces located on the handle portion and the catch, the releasable catch mechanism located in the handle portion being configured such that an axial force applied to the tubular wand will urge the catch into the detent.

9. A handle assembly as claimed in claim 1 or 2, wherein the second end of the flexible hose is releasably connected to the handle portion.

10. A handle assembly as claimed in claim 1 or 2, wherein the handle portion carries a moveable cap which is arranged to cover one end of the tubular wand when the tubular wand is in the first position.

11. A handle assembly as claimed in claim 1 or 2, wherein the tubular wand is adapted to receive accessories for the cleaning appliance at one end thereof.

12. A handle assembly as claimed in claim 11, wherein the said end of the tubular wand carries a stop which prevents the upper end of the tubular wand from sliding to an inaccessible position inside the handle portion.

13. A handle assembly as claimed in claim 1 or 2, wherein the handle portion carries a gripping handle.

14. A handle assembly as claimed in claim 13, wherein the gripping handle comprises a first gripping area suitable for use when the tubular wand is in the first position and a second gripping area suitable for use when the tubular wand is in the second position.

15. A handle assembly as claimed in claim 1 or 2, wherein, when the tubular wand is in the first position, the tubular wand extends substantially along the full length of the flexible hose.

16. A vacuum cleaner comprising the handle assembly as claimed in claim 1 or 2.

* * * * *